US005422649A

United States Patent [19]

Huang

[11] Patent Number: 5,422,649

[45] Date of Patent: Jun. 6, 1995

[54] PARALLEL AND SERIES FED MICROSTRIP ARRAY WITH HIGH EFFICIENCY AND LOW CROSS POLARIZATION

[75] Inventor: John Huang, Arcadia, Calif.

[73] Assignee: The United States of America as represented by the Administrator of the National Aeronautics and Space Administration, Washington, D.C.

[21] Appl. No.: 304,641

[22] Filed: Sep. 9, 1994

Related U.S. Application Data

[63] Continuation of Ser. No. 56,018, Apr. 28, 1993, abandoned.

[51] Int. Cl.[6] ..... H01Q 1/38

[52] U.S. Cl. ..... 343/700 MS

[58] Field of Search ..... 343/700 MS; H01Q 1/38

[56] References Cited

U.S. PATENT DOCUMENTS

| | | | |
|---|---|---|---|
| Re. 29,911 | 2/1979 | Munson | 343/700 MS |
| 4,063,245 | 12/1977 | James et al. | 343/700 MS |
| 4,180,817 | 12/1979 | Sanford | 343/700 MS |
| 4,475,107 | 10/1984 | Makimoto et al. | 343/700 MS |
| 4,686,535 | 8/1987 | Zalezari | 343/700 MS |
| 4,713,670 | 12/1987 | Makimoto et al. | 343/700 MS |
| 4,833,482 | 5/1989 | Trinh et al. | 343/700 MS |
| 4,899,163 | 2/1990 | Daniel et al. | 343/700 MS |
| 4,929,959 | 5/1990 | Sorbello et al. | 343/700 MS |
| 5,006,858 | 4/1991 | Shirosaka | 343/700 MS |
| 5,017,931 | 5/1991 | Carlyon | 343/700 MS |
| 5,233,361 | 8/1993 | Bogvais | 343/700 MS |

FOREIGN PATENT DOCUMENTS 2606271 2/1976 Germany .

0120559 9/1979 Japan .

OTHER PUBLICATIONS

John Huang, Dual-Polarized Microstrip Array with High Isolation and Low Cross-Polarization, Microwave & Optical Technology Letters, vol.4, No. 3, Feb. 1991, pp. 99-103.

*Primary Examiner*—Donald Hajec
*Assistant Examiner*—Steven P. Wigmore
*Attorney, Agent, or Firm*—John H. Kusmiss; Thomas H. Jones; Guy M. Miller

[57] ABSTRACT

A microstrip array antenna for vertically polarized fan beam (approximately 2°×50°) for C-band SAR applications with a physical area of 1.7 m by 0.17 m comprises two rows of patch elements and employs a parallel feed to left- and right-half sections of the rows. Each section is divided into two segments that are fed in parallel with the elements in each segment fed in series through matched transmission lines for high efficiency. The inboard section has half the number of patch elements of the outboard section, and the outboard sections, which have tapered distribution with identical transmission line sections, terminated with half wavelength long open-circuit stubs so that the remaining energy is reflected and radiated in phase. The elements of the two inboard segments of the two left- and right-half sections are provided with tapered transmission lines from element to element for uniform power distribution over the central third of the entire array antenna. The two rows of array elements are excited at opposite patch feed locations with opposite (180° difference) phases for reduced cross-polarization.

4 Claims, 4 Drawing Sheets

PARALLEL AND SERIES FED MICROSTRIP ARRAY WITH HIGH EFFICIENCY AND LOW CROSS POLARIZATION

ORIGIN OF INVENTION

The invention described herein was made in the performance of work under a NASA contract, and is subject to the provisions of Public Law 96-517 (35 USC 202) in which the contractor has elected not to retain title.

This application is a continuation of application Ser. No. 08/056,018, filed Apr. 28, 1993, now abandoned.

TECHNICAL FIELD

The invention relates to a linearly polarized microstrip array antenna having two long rows of patch elements with transmission lines for parallel/series feed from coax probes arranged for low cross polarization and high efficiency.

BACKGROUND ART

A low-profile antenna with a vertically polarized fan beam (approximately 2°×50°) is needed for C-band Aircraft Interferometric SAR (Synthetic Aperture Radar) applications. The main beam of the antenna is required to be fixed at the broadside direction. The available physical area for the antenna is 1.7 m by 0.17 m. To conformably mount the antenna outside the aircraft's surface, microstrip array structure with thin substrate material is ideal for the application.

The simplest form of feed system for such a relatively long microstrip array is series feeding in which not only the dielectric insertion loss of the feed transmission lines is minimized but the leakage radiations from the lines are also reduced when compared to a complete corporate feed system. In addition, the space usage of the given aperture is significantly improved in a series fed array structure.

There are two types of series feeding techniques: resonant feed and traveling wave feed. In a resonant feed array, no impedance matching to the elements is necessary and the resulting multiply bounced waves in the transmission line will radiate into space through the elements with phases equal to the primary radiated waves due to proper element spacing. However, because of the multiple bounces, the insertion loss that occurs in the transmission line of a resonant feed array is generally higher than that in a traveling wave feed array. In addition, because of the phase coherence requirement of the multiply bounced waves, the resonant array has extremely narrow bandwidth. The traveling wave feed technique is therefore preferred, but that type of series feeding has its own problems of beam squint and insertion loss. This is because the main beam angle of an array series fed from one end will be very sensitive to frequency change due to the progressive phase change of the series fed elements.

STATEMENT OF THE INVENTION

An objective of this invention is to feed a large number of microstrip patch elements of a relatively long microstrip array (e.g., 1.7 m long and 0.17 m wide) with high efficiency and low cross polarization. These and other objectives are achieved in a microstrip array having long rows of patch elements (e.g., 36 patch elements) with a parallel and series feed architecture with three stages of parallel feed and using matched transmission lines. The array is divided into two (left and right) sections, one being a mirror image of the other. Each section is fed at a location one third the length of the array measured from the center out in each left and right section so that the total number of elements in each row in this example is divided into two sections (of 18 elements in this example), and each section is divided into two segments, the inboard segment having half the number of patch elements as the outboard segment with both segments fed in parallel/series, i.e., fed in parallel from two points, one point in each section between the inboard and the outboard segment with the elements of the two segments of each section fed in series. The feed location for each section is chosen between the two rows of patch elements to be 90° phase offset from a vertical center between the rows (spaced a fraction of a dielectric wavelength apart selected for a desired elevation beamwidth when used for a vertically polarized fan beam for SAR applications) so that the two rows of patch elements are excited at opposite patch feed locations with opposite phases (180° difference) so that cross-polarization radiations of the array are reduced. The outboard segment of elements of each section are series fed through identical transmission lines from element to element for tapered power distribution with a half wavelength open circuit stub at the end of each row so that any remaining energy will be reflected and radiated in phase with the radiated energy from the forward traveling wave, i.e., the wave traveling from the feed to the termination. The inboard segments of elements of each section are series fed with tapered transmission line widths for uniform power distribution. The transmission lines to every element is matched to the microstrip patch element for high efficiency throughout.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
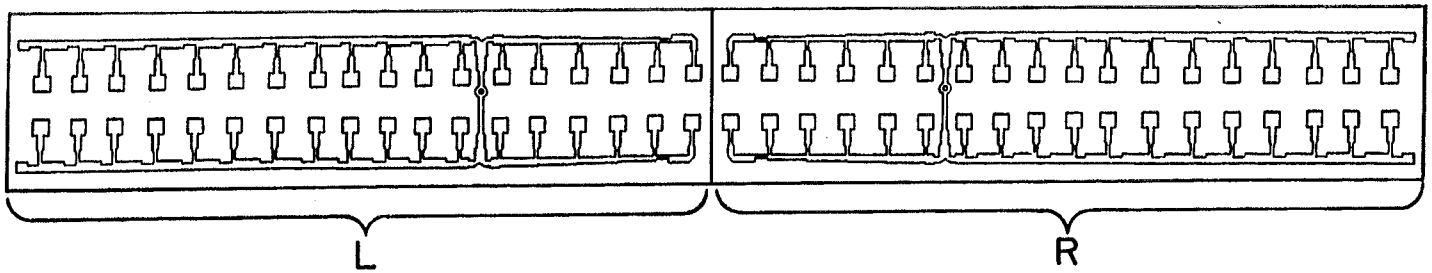
FIG. 1 is a schematic diagram of a microstrip array with parallel/series feed in accordance with this invention.

Referring to FIG. 1, the traveling wave array of the present invention comprises two rows of 36 patch elements. For parallel/series feed, the array is divided into two equal sections, a left hand section L and a right hand section R. The right half section R is shown to a larger scale in FIG. 2. The left half section L, not shown to a larger scale, is a mirror image of the right half. Both rows of the right half section are fed by a coax probe at the back of the array in a location 10 offset 90° from a vertical center point between the rows. The impedance of the transmission feed line is not only matched at the input location 10 but also matched to all the power division points 11 and 12 and to all the patch elements 13.

Generally a small percentage of power is lost in a matched load at the end of a traveling feed, but in the present invention a half-wavelength open-circuit stub 14 is provided at the end of each row so that the remaining energy after the last element is reflected from the stub 14 and radiated into space through the patch elements nearer to the stub. Because of the required broadside beam radiation and the consequent design of the one-wavelength spacing (in dielectric) between elements, the reflected energy from the open-circuit stub is in phase with all the forward traveling waves at all the element locations. As a result, very little energy is wasted.

Figure 2:
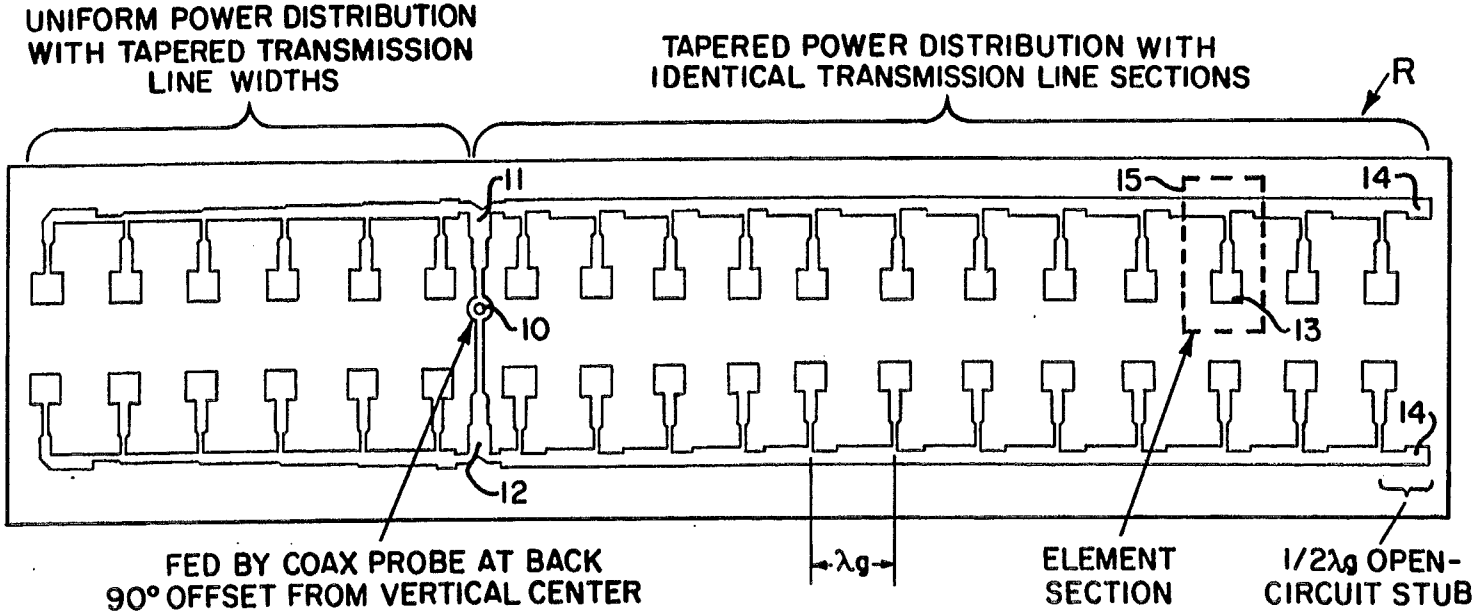
FIG. 2 is a schematic diagram of the right-half section of the array shown in FIG. 1 with the scale of the drawing larger but with dimensions not to scale and not to the true proportion of the actual antenna described as an example for C band.

Another special feature of this invention is that the adjacent two segments of 6 and 12 series fed elements in the two rows in the right half section are excited in parallel with opposite feed locations from the top for the elements in the upper row and from the bottom for the elements in the lower row as shown in FIG. 2, and with opposite phases (i.e., with 180° antiphase feed due to the 90° offset of the coax probe at the array feed location 10). In doing so, the higher-order-mode radiations from the patches are canceled and the spurious leakage radiations from the transmission lines are also canceled. The result is a very pure vertically polarized radiation with very low cross polarization.

In a complete series feed array, the input power to the antenna comes from one end of the array. With such one-end feeding, the main beam angle will be very sensitive to frequency change due to the progressive phase change of the series fed elements. To avoid this main beam squint as frequency changes, a combination of parallel and series feed techniques is used. In that manner, if a linear array is parallel fed at the center of the antenna, for example, while each half of the array is series fed, although the beam angle of each half array will squint away from broadside as frequency changes, the combined beam of the whole array will remain pointed in a broadside direction. Gain degradation will certainly occur due to the combination of the two off-broadside pointed beams. Consequently, the gain bandwidth product of a parallel/series fed array is generally small. This gain bandwidth performance, however, can be improved if the number of parallel-fed stages increases. The array design of the present invention, as illustrated in FIG. 1, has a three-stage parallel fed configuration because the total length of the array (36 elements) is first divided into 18 elements in each of two sections, and each section is divided into a segment of 6 elements and a segment of 12 elements, although all four segments are effectively grouped into three segments of 12 elements. Thus, the 6 inboard elements of the right-hand section R shown in FIG. 2 combine in operation with the 6 inboard elements of the left-hand section L to function as one segment in the third stage of the parallel fed configuration. Good gain bandwidth performance has been achieved with this unique parallel fed configuration.

The array shown in FIG. 1 thus consists of a total of 72 identical square microstrip patches that are arrayed in two rows of 36 elements. The array is designed to resonate at 5.30 GHz. The dielectric substrate of the microstrip array has a relative dielectric constant of 2.17 and a thickness of 0.16 cm. Element spacing in the horizontal direction is one dielectric wavelength or 0.74 free space wavelength. This one dielectric wavelength spacing is needed to achieve broadside radiation with equal phases from all the series fed elements. Element spacing in the vertical direction is 0.56 free space wavelength which is designed to achieve the required elevation beamwidth. Overall length of the array, including mounting areas at both ends, is 1.68 meters, and the width is 0.17 meter.

Figure 3:
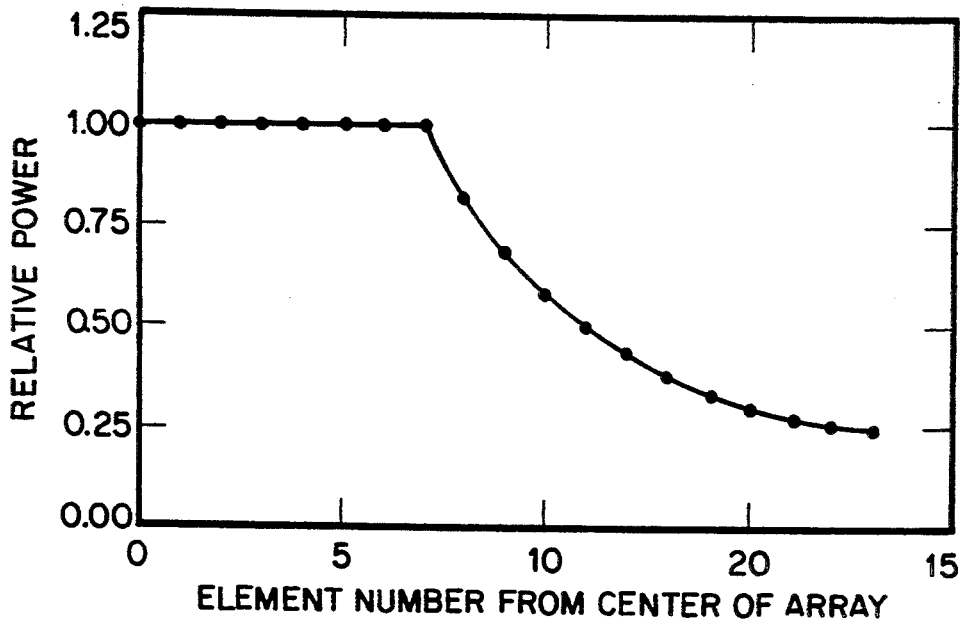
FIG. 3 is a diagram of relative power distribution of only the right-hand section shown in FIG. 2, the left-hand section being a mirror image of the right-hand section.

Because no manufacturer can supply a single low-loss dielectric board with such a length, the whole antenna is made of two identical halves that are combined electrically by a coax power divider (matched T) not shown and two coax cables. Along each row of the array, the center twelve elements are designed to have uniform power distribution, while the 12 elements at each end of the array have tapered power distribution which is computer designed for a −20 dB sidelobe performance. The power distribution of half the array is shown in FIG. 3 where the relative power in ratio (referenced to the center elements) is plotted as a function of element number.

As noted hereinbefore, the right-section half R of the complete array shown in FIG. 1 is shown in FIG. 2 to a greater scale for more detailed presentation. It is clearly indicated in this figure that the coax probe is fed off center in the vertical direction by 90° in phase so that the top row and the bottom row elements are excited 180° out of phase. With this antiphase feeding and opposite feed locations for these two rows of elements, the undesirable cross-polarization radiations from the higher order modes of the patches will cancel each other in the far field. In addition, due to this antiphase feeding, most of the leakage radiations from the two rows of microstrip transmission lines will also cancel in the far field, which will further reduce the cross-polarization level.

One reason that the array is coax fed in the horizontal direction between the 6th and 7th elements from the center of the array is to achieve proper amplitude taper with appropriate amount of energy reflected from the end of the array. In this design, approximately 11% of input power goes into and is reflected by the open-circuit stubs at the two ends. Another reason for the feed location is to avoid a design with too thin a microstrip line which may cause fabrication tolerance problems and be more prone to be damaged in handling.

Figure 4:
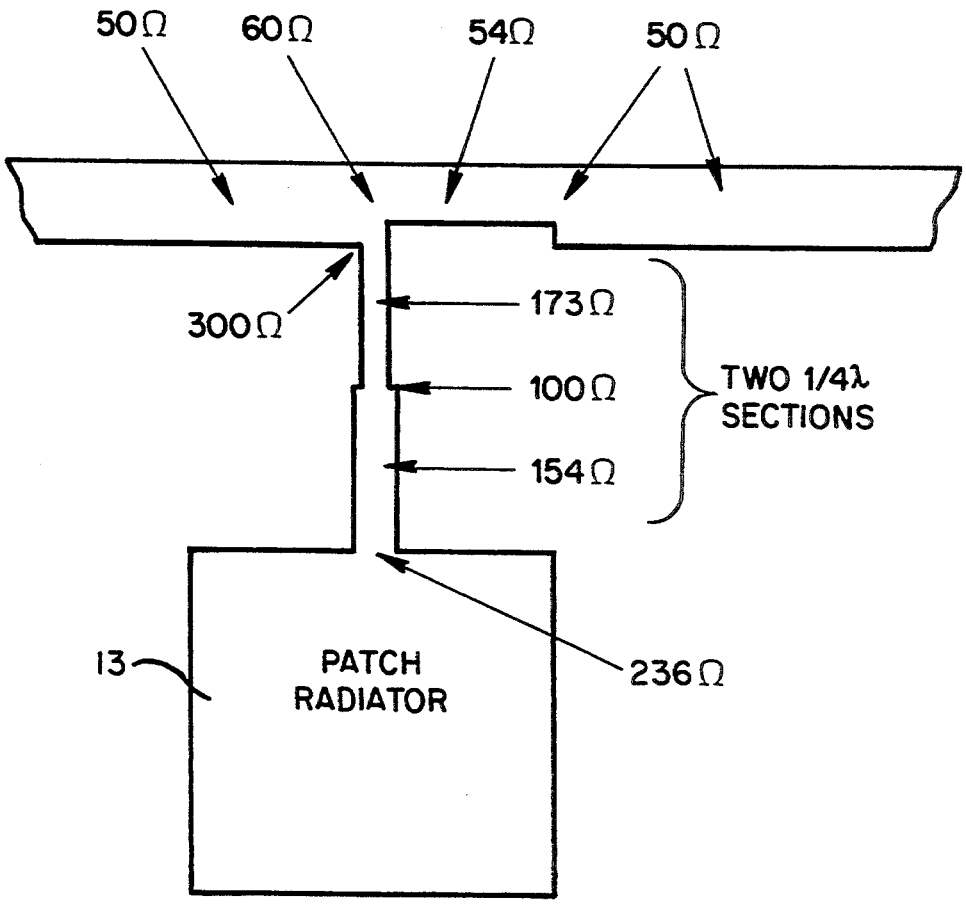
FIG. 4 illustrates impedance transformations of the element section shown in FIG. 2 in a dotted line box.

In FIG. 2, the 12 elements to the right side of the probe feed has tapered amplitude distribution with all element feed transmission sections having identical microstrip lines. In each element section, indicated in a dotted line box 15, one sixth of the incoming power traveling to the right is radiated by the patch. To achieve such a power division, a very high impedance ($\approx$250 ohm) and very thin ($\approx$0.05 mm) line is generally needed to transform a 300 ohm high-impedance line to a 236 ohm high-input-impedance patch. This extreme thin line is avoided by using two quarter-wave transformers for impedance matching in each element section as shown in FIG. 4. The highest impedance line into the patch 13 has an impedance of 173 ohm with a line width of 0.3 mm which is much more tolerable than 0.05 mm. For the array, if the probe feed location is moved toward to the left in FIG. 2, the fraction of power radiated by the patch in each element section will be smaller in order to achieve a similar amplitude taper. This will result in lines thinner than 0.3 mm which is not acceptable. On the other hand, if the feed probe is moved toward to the right of the array, not only will the reflected energy from the end of the array become more significant and travel into the feed probe to cause a mismatched input impedance, but also the length of the coax cables that combines the two half arrays will become longer and result in a higher loss.

From the foregoing discussion, it is apparent that there are many factors that determine the probe feed location for this array. One other point to be noted is that if the whole array could have been made as a single dielectric board instead of two, one for each left- and right-hand section L and R, microstrip lines would have been used to combine the two half sections instead of the coax cables, which should make the overall array more efficient.

Array Performance

Figure 5B:
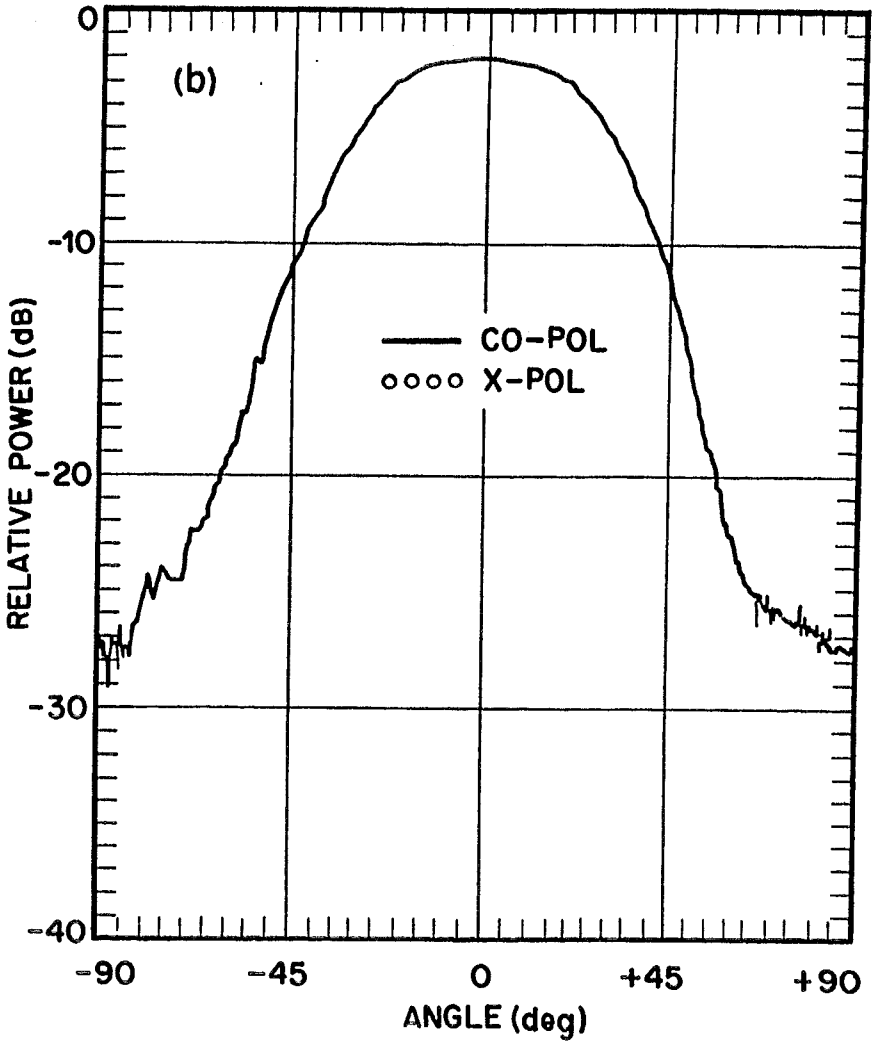
FIGS. 5(*a*) and 5(*b*) are diagrams of the measured principal-plane patterns of the respective H-plane and the E-plane.
Figure 5A:
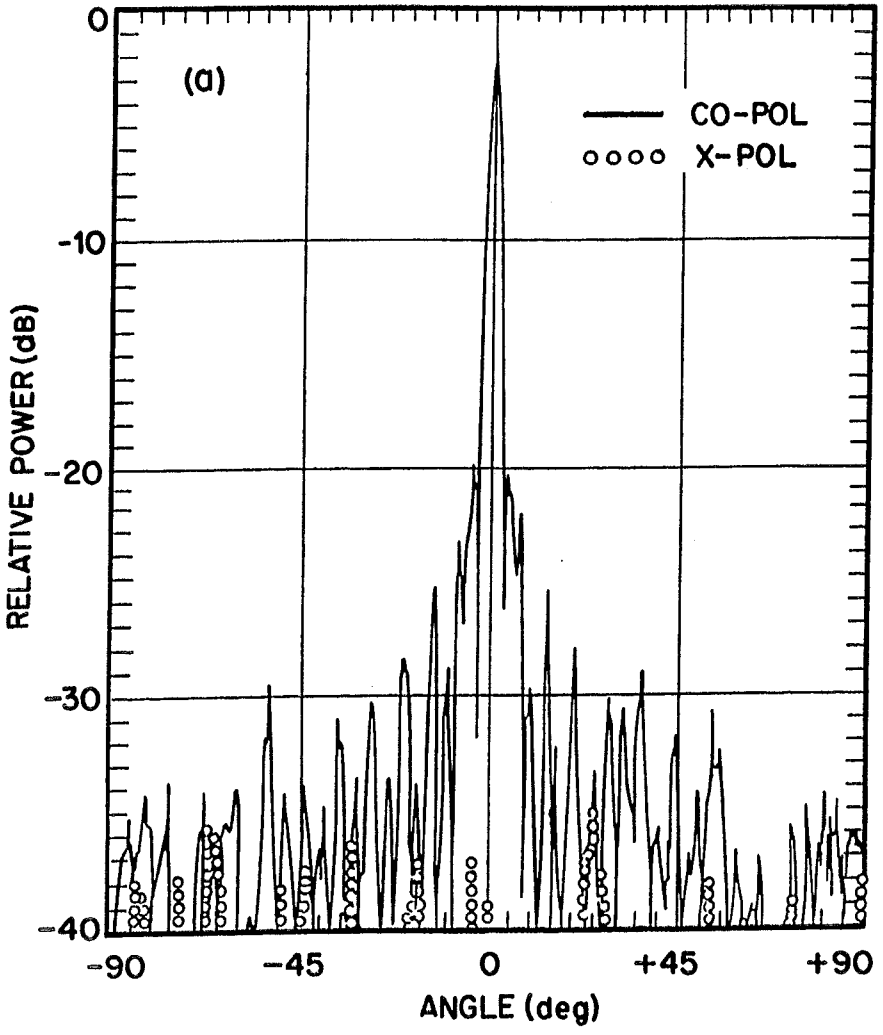
Figure 6:
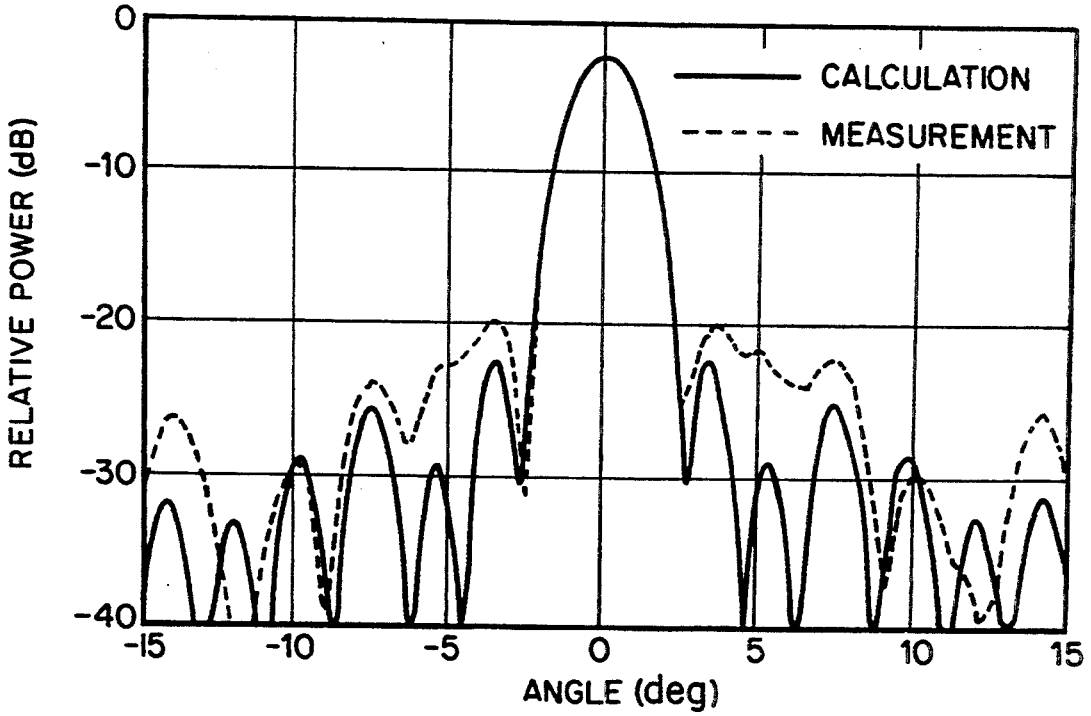
FIG. 6 is a graph of measured and calculated narrow-beam patterns of the array of FIG. 1 as described with reference to FIGS. 2, 3 and 4.
Figure 7:
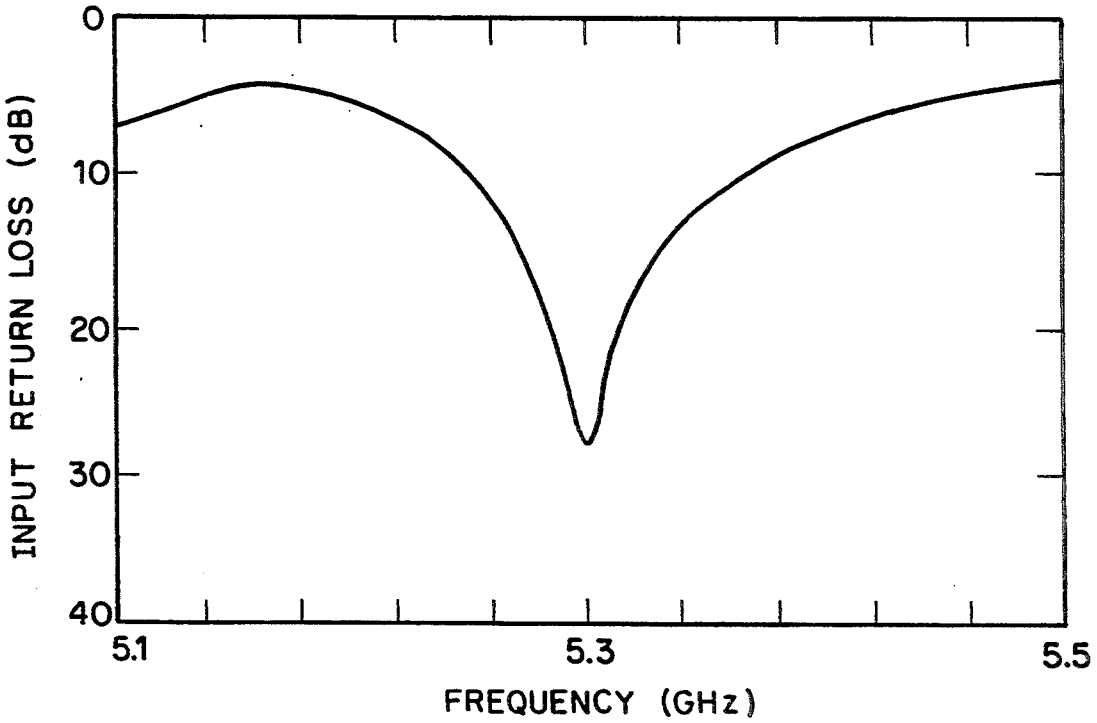
FIG. 7 is a graph of return loss versus frequency for each half section of the array of FIG. 1.

The measured two principal-plane patterns of the complete assembled array are presented in FIG. 5 where the narrow beamwidth is 2.1° and the broad beamwidth is 57.2°. Since the design of the amplitude taper is of some importance here, the measured narrow beam pattern is compared with that of the calculated as presented in FIG. 6. Relative good agreement between the two patterns indicates that the array is performing properly according to the design. FIG. 7 gives the input return loss that measured at the coax input to each half array. The 1.5:1 VSWR bandwidth is 58 MHz while the 2:1 VSWR bandwidth is 120 MHz. The complete array suffered a 1 dB gain drop at about ±30 MHz away from the center frequency of 5.30 GHz. At the center frequency, the measured antenna peak gain, referenced to the input of the coax power divider, is 23.80 dBi, while the calculated directivity is 25.26 dBi. The insertion loss of the coax power divider and coax cables is measured to be 1.10 dB which implies that the loss in the microstrip array is only 0.36 dB (92% efficiency). It is estimated that 86% to 88% of efficiency can be achieved by the complete antenna if the two half arrays are connected by microstrip lines instead of coax cables. This good antenna efficiency is mainly attributed to the unique parallel and series feed configuration designed here and to the effective utilization of the reflected power from two ends of the array. The cross polarization measured at all angular directions (within ±90° from array broadside) in the two principal planes, as shown in FIG. 5, has a peak value of −33 dB from the peak of the co-polarization and an average value of about −45 dB. This low cross-polarization level is primarily the result of the antiphase feed technique being utilized here.

Although a particular embodiment of the invention has been described and illustrated herein, it is recognized that modifications and equivalents may readily occur to those skilled in the art, such as in the number of rows in a long and narrow array and the division of the rows to provide three stages of parallel feed. Consequently, it is intended that the claims be interpreted to cover such modifications and equivalents.

I claim:

1. A long microstrip array for a predetermined free-space wavelength comprising:

two parallel rows of radiation patch elements of equal number, said two parallel rows spaced a dielectric wavelength apart and divided into multiple sections with parallel feed to corresponding sections of each of said two parallel rows, said sections of two parallel rows forming at least one inboard section and at least one outboard section, said patch elements of one row being positioned in line directly opposite corresponding patch elements of the other row so as to form mirror image parallel rows of radiation patch elements, said patch elements being spaced from adjacent patch elements a full dielectric wavelength for serial feed of each row in each section with matched transmission lines, two half dielectric wavelength long open circuit stubs, each stub terminating each row of each outboard section of said two parallel rows so that remaining energy from forward traveling waves in each outboard section of said two parallel rows will be reflected and radiated by nearby radiation patch elements in phase with energy from subsequent forward traveling waves in each outboard section of said two parallel rows, and means at a location 90° phase offset from a geometric center point between said two parallel rows for providing excitation to said two parallel rows of radiation patch elements with 180° phase difference at a top feed location of one row relative to a phase present at a bottom feed location of the other row of said two parallel rows, whereby cross-polarization radiation of said two parallel rows of radiation patch elements is reduced.

2. A long microstrip array antenna as defined in claim 1 wherein said two rows of radiation patch elements are divided into right-half and left-half sections, and each half section is divided into two segments, one inboard segment and one outboard segment, and said means for providing excitation to said two rows of radiation patch elements with 180° phase difference comprises parallel feed to each half section at said location 90° phase offset from said geometric center point between said two rows, said radiation patch elements of said two rows spaced a dielectric wavelength apart being positioned opposite each other, whereby said top patch feed locations for radiation patch elements of one row relative to said bottom feed locations of corresponding radiation patch elements of the other row of said two rows of radiation patch elements are fed with 180° phase difference.

3. A long microstrip array antenna as defined in claim 2 wherein said radiation patch elements in each outboard segment of each half section of said two rows of radiation patch elements terminated with said half dielectric wavelength long open circuit stub is fed in series through identical transmission line widths from element to element for tapered power distribution, and said radiation patch elements in each inboard segment of each half section are fed in series through tapered transmission line widths from element to element for uniform power distribution.

4. A long microstrip array antenna as defined in claim 3 wherein each inboard segment of each half section of said two rows of radiation patch elements has half as many radiation patch elements as said outboard segments of each said half sections, thereby to provide two outboard segments for each row with an equal number of radiation patch elements and to effectively provide a central third segment of equal number of radiation patch elements as said outboard segments.

* * * * *